United States Patent [19]

Coates et al.

[11] 4,437,956

[45] Mar. 20, 1984

[54] METHOD FOR PREPARING SURFACES OF METAL COMPOSITES HAVING A BRITTLE PHASE FOR PLATING

[75] Inventors: Cameron W. Coates, Knoxville; Thomas J. Wilson, Clinton, both of Tenn.

[73] Assignee: The United States of America as represented by the United States Department of Energy, Washington, D.C.

[21] Appl. No.: 379,799

[22] Filed: May 19, 1982

[51] Int. Cl.[3] ..... C23F 1/02; C25F 3/08; C25D 5/38

[52] U.S. Cl. ..... 204/129.35; 156/651; 156/656; 156/666; 204/29; 204/32 R; 204/129.75

[58] Field of Search ..... 204/29, 32 R, 129.35, 204/129.75, 141.5; 156/651, 654, 666, 655, 656, 664

[56] References Cited

U.S. PATENT DOCUMENTS

| | | | |
|---|---|---|---|
| 2,412,058 | 12/1946 | Pfeil | 204/129.35 X |
| 2,504,906 | 4/1950 | Tremblay | 204/32 R X |
| 2,884,364 | 4/1959 | Rebol et al. | 204/141.5 X |
| 3,287,238 | 11/1966 | Latawiec et al. | 204/141.5 X |

FOREIGN PATENT DOCUMENTS

| | | | |
|---|---|---|---|
| 2141269 | 3/1973 | Fed. Rep. of Germany | 204/32 R |
| 811432 | 4/1959 | United Kingdom | 204/32 R |

*Primary Examiner*—G. L. Kaplan
*Assistant Examiner*—T. L. Williams
*Attorney, Agent, or Firm*—Earl L. Larcher; Stephen D. Hamel; Michael F. Esposito

[57] ABSTRACT

The present invention is directed to a method for preparing surfaces of two-phase metal composites having relatively brittle and malleable components for plating with corrosion-resistant material. In practice of the present invention, the surfaces of the composites are etched to remove a major portion or fraction of the brittle component. The etched surface is then peened with particulates for breaking the brittle component from the surfaces and for spreading or smearing the malleable component over the surfaces. The peened surface is then chemically cleaned of residual traces of the brittle component so as to provide a surface of essentially the malleable component to which the corrosion-resistant material may be plated thereon in an adherent manner.

4 Claims, No Drawings

METHOD FOR PREPARING SURFACES OF METAL COMPOSITES HAVING A BRITTLE PHASE FOR PLATING

The present invention was made as a result of a contract with the United States Department of Energy.

BACKGROUND OF THE INVENTION

The present invention relates generally to a method for preparing exposed surfaces of metal composites for plating with corrosion-resistant material, and more particularly to such surface preparation of two-phase metal composites in which one of the phases is more brittle than the other phase.

Many metals and metal systems such as alloys and composites used in structural applications because of their particular properties suffer corrosion problems upon exposure to the gaseous or liquid environment in which they are used. These metals and metal systems are protected from such corrosion by coating them with a suitable plating material which affords the necessary corrosion protection.

While the plating of most metals and alloys is readily achieved, some difficulties have occurred in attempting to protect two-phase metal composites in which one of the metal phases is substantially more brittle than the other phase, for example, tungsten particulates in a copper matrix. The presence of the tungsten particulates renders the plating operation very difficult, since the plating material will not readily adhere to the particulates while adhering to the matrix material so as to cause the plating to be less adherent to the composite than desired.

SUMMARY OF THE INVENTION

The present invention is directed to a method for preparing surfaces of metal composites having a brittle phase and a malleable phase for plating with a corrosion-resistant material. Generally, the present invention comprises the steps of selectively removing a major portion of the relatively brittle metal component from exposed surfaces of the composite by etching. The exposed surfaces are sufficiently peened to essentially deplete the exposed surfaces of the brittle metal component and to spread the relatively malleable metal component over the surface. The surface is then subjected to a chemical cleaning for removing residual brittle metal from the exposed surface. The exposed surfaces are then plated with at least one layer of the plating material by following conventional plating practices utilized for the malleable metal component. The resulting coating is adherent to the surface of the composite and yet the composite retains essentially the properties required of the composite for its intended use.

Other and further objects of the invention will be obvious upon an understanding of the illustrative method about to be described or will be indicated in the appended claims, and various advantages not referred to herein will occur to one skilled in the art upon employment of the invention in practice.

DETAILED DESCRIPTION OF THE INVENTION

Metal composite systems are frequently formed by employing a two-phase system wherein a refractory metal or carbide is encased in a matrix metal so as to form a composite. In such instances there exists two phases wherein the refractory metal or carbide is substantially more brittle than the matrix material which is usually formed of a relatively malleable metal. Examples of such two-phase composites include tungsten particles embedded in a copper matrix. Tungsten-silver and tungsten carbide-cobalt are examples of other composites which may be prepared for plating by practicing the present invention.

As pointed out above, the plating of composites containing two significantly different metal phases has been somewhat difficult due to the lack of adherence of the coating material to both of the metals on the surface of the composite. The present invention significantly obviates this problem by utilizing selected steps which prepare the surface of the composite for receiving an adherent coating of material without deleteriously detracting from the properties of the composite. For example, a tungsten-copper composite is characterized by two distinct phases, the copper matrix being relatively malleable while the tungsten particulates embedded in the matrix are hard and brittle. To provide this composite within an adherent coating, the composite surface, i.e., the selected segment of the surface to which the plating is to be applied, is first chemically etched to deplete the surface of a major portion of the tungsten particulates or the brittle component in the composite. In such an etching operation, the brittle metal particulates are loosened from the matrix by dissolving the matrix material about the particulates. Alternatively, in some instances it may be preferred to selectively dissolve the brittle component. After the chemical etching step, the surface is rinsed with distilled water and then dried. The surface of the metal composite is then subjected to a peening operation wherein the surface is bombarded with particulates for effecting both the further removal of the brittle particulates from the surface and the spreading of the malleable component over the surface. On completion of the peening operation, the residual quantities of the brittle component remaining on the surface are chemically removed so as to provide the composite with a surface consisting essentially of only the malleable component. With the surface so prepared, the composite may then be subjected to a conventional plating operation utilized for plating the malleable component.

The peening of the composite surface may be achieved by contacting the surface with glass or carbide beads traveling at a sufficient velocity so as to dislodge the particulates from the matrix. Normally, a bombardment of the surface with the particulates for a duration of about 0.25 to 1 minute per square inch is sufficient to effect the desired peening of the surface for the removal of the brittle particulates from the surface as well as effectively spreading the malleable component over the surface. This spreading of the malleable component also effectively fills the voids remaining where the brittle particulates were previously confined.

A rod of tungsten 30 wt.% copper of 0.5 inch diameter and 3 inch length was utilized in a demonstration of the present invention. The tungsten particulates provided brittle exposed edge surfaces on the surface of the rod which had to be depleted of the sharp edges so as to provide an adherent coating on the rod. In accordance with the present invention, the rod was subjected to an electrochemical etching operation in a warm dilute, e.g., 10 wt.% sodium hydroxide solution with 6 volts for a duration of 5 minutes followed by a thorough washing in distilled water and then drying the surface.

The composite was then peened with glass beads for about 3–4 minutes to spread the copper matrix essentially uniformly over the entire surface. This peening also removed tungsten particulates remaining or embedded in the matrix surface that were not removed during the electrochemical etching. Following the peening operation, the composite surface was again subjected to an electrochemical etching operation in the aforementioned solution at 6 volts for 2 minutes followed by a thorough rinsing with distilled water and then drying.

With the surface of the composite so prepared, the copper matrix formed essentially the entire exposed surface of the composite. This surface was then provided with a strike coat of copper in an alkaline copper cyanide bath by placing the rod in a bath for a duration of about 15 to 30 seconds and then plating the surface at a current of 20 amperes per square foot for a duration of 5 minutes. The copper rod with the strike coat was then electroplated with nickel in a nickel-sulfamate bath for a duration of 5 hours at 20 amperes of current per square foot of surface area. Examination of the electroplated layer of nickel indicated that the nickel layer was about 0.005 to 0.010 inch in thickness and was tenaciously adherent to the surface of the composite.

It will be seen that the present invention provides a relatively simple procedure for preparing two-phased metal composites wherein refractory or carbide particulates are encased within a malleable metal matrix for plating with a protective coating.

What is claimed is:

1. A method for preparing the surfaces of a two-phased metal composite for a plating with a corrosion-resistant material when the composite is formed of a relatively brittle refractory metal or carbide particulate component in a matrix of metal of greater malleability than the brittle metal or carbide component comprising the steps of selectively etching a major portion of the brittle component from the exposed surfaces of the composite, sufficiently peening the exposed surfaces of the composite to essentially deplete the latter of the brittle metal component and to spread the relatively malleable matrix metal on the exposed surfaces, and thereafter chemically removing residual particulates of the brittle component from the exposed surface so as to provide a surface on the composite consisting essentially of the malleable matrix metal for reception of an adherent plating of the corrosion resistant material.

2. The method of claim 1, wherein the composite is tungsten in a matrix selected from the group of 15 to 30 wt.% copper, silver and cobalt.

3. The method claimed in claim 2, wherein the composite is tungsten—15 to 30 wt.% copper, and wherein the steps of etching a major portion of the brittle component from exposed surfaces of the composite and chemically removing residual particulates of the brittle component from the exposed surface are electrochemically achieved in dilute sodium hydroxide solution.

4. The method claimed in claim 2, wherein the peening step is provided by bombarding the exposed surfaces of the composite with glass beads for a duration sufficient to effect the spreading of the relatively malleable metal on the exposed surfaces.

* * * * *